US005284280A

United States Patent [19]

Stonebraker, Sr. et al.

[11] Patent Number: 5,284,280

[45] Date of Patent: Feb. 8, 1994

[54] ADJUSTABLE-BACKPACK-SHOOTING TABLE

[76] Inventors: John W. Stonebraker, Sr., 21st St. Ext.; Daniel P. Stonebraker, R.D. 3, Box 113D, both of Tyrone, Pa. 16686

[21] Appl. No.: 998,140

[22] Filed: Dec. 28, 1992

[51] Int. Cl.[5] ..... A45F 4/02

[52] U.S. Cl. ..... 224/153; 224/210; 224/907; 224/913; 42/94

[58] Field of Search ..... 224/153, 155, 156, 210, 224/211, 212, 213, 261, 262, 263, 913, 907; 42/94; 89/37.04

[56] References Cited

U.S. PATENT DOCUMENTS

| | | | |
|---|---|---|---|
| 1,561,564 | 11/1925 | Nizamis | 224/913 |
| 3,662,932 | 5/1972 | Kerschner | 224/155 |
| 4,506,466 | 3/1985 | Hall | 42/94 |
| 4,535,559 | 8/1985 | Hall | 42/94 |
| 4,830,245 | 5/1989 | Arakaki | 224/153 |
| 4,842,173 | 6/1989 | Scherer | 224/210 |
| 4,896,804 | 1/1990 | Dearborn et al. | 224/153 |

FOREIGN PATENT DOCUMENTS

| | | | |
|---|---|---|---|
| 406374 | 11/1943 | Italy | 224/913 |
| 212957 | 12/1940 | Switzerland | 224/913 |

*Primary Examiner*—Linda J. Sholl
*Attorney, Agent, or Firm*—Thomas E. Sterling

[57] ABSTRACT

This invention is a portable shooting table adapted to be transported as a backpack during a hunt and assembled n the field. It is comprised of an adjustable length frame with a backpack attached. Adjustable legs carried in the backpack are screwably attached to the frame. When it is being used as a shooting table, an adjustable gun rest attached to the frame supports a rifle. The frame has rigid transverse members to support the arms and firearm of the shooter while the firearm is being aimed. Shoulder straps attached to the frame enable the shooter to shoulder carry the shooting table in the manner of a knapsack.

8 Claims, 2 Drawing Sheets

Fig. 3.
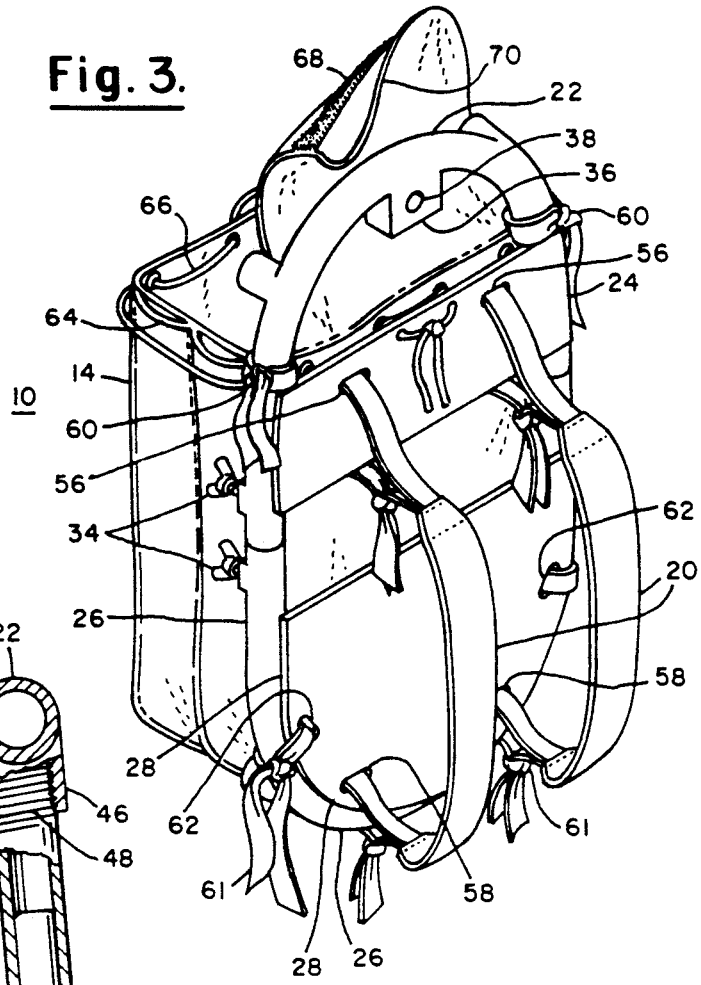
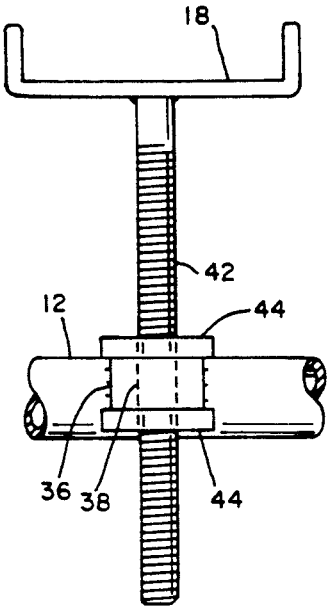
Fig. 4.
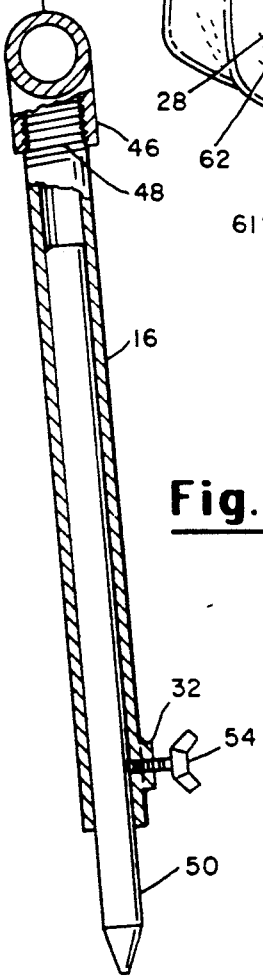
Fig. 5.
Fig. 6.
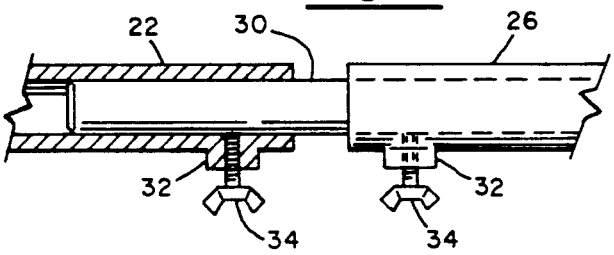

ADJUSTABLE-BACKPACK-SHOOTING TABLE

FIELD OF THE INVENTION

This invention relates to shooting tables and in particular to portable shooting tables which may be carried into the hunt on a backpack frame, reassembled and used in the field under hunting conditions.

BACKGROUND OF THE INVENTION

When sighting a rifle at a rifle range, the shooter often sits on a shooting bench equipped with sand bags or other devices to support his rifle during the aiming process. The bench is designed to be firm and to hold the rifle in a motionless position while it is being aimed. The greatest accuracy with a rifle is obtained by the use of a shooting bench.

However the ordinary shooting bench is usually a heavy and difficult to move object which can not be easily transported or used during the hunt. In the hunting situation the hunter often-times finds himself at a distance from his quarry with little or no effective means to support the rifle for a long shot. Hence while hunting the hunter is deprived of a shooting bench type device which would aid his accuracy for a long distance shot. Some attempts have been made to provide a portable shooting bench; however, most of these are cumbersome, heavy and not adapted to be set up in the field.

There is a need for a shooting bench which can be easily carried into the field during the hunt and set up. This invention fulfills that need.

The below listed patents relate to the applicants invention.

Applicants know of no other pertinent relating patents.

| Patent No. |
|---|
| 3,125,929 |
| 3,493,153 |
| 4,286,739 |
| 4,506,466 |
| 4,702,029 |
| 4,738,383 |
| 5,016,792 |
| Des. |
| 284,910 |
| 311,813 |

SUMMARY OF THE INVENTION

The theory of the invention is to provide a light weight but very stable shooting table which may be carried on your back in the form of a backpack. The frame of the backpack, which is tubular aluminum, transforms into a rigid shooting table top. The frame is in the approximate shape of an oval and can be elongated by several inches at the option of the user. This extension is made by telescoping the special made extension elements in the oval frame.

During transportation the legs of the shooting table may be carried in side pockets of the backpack. But, if desired, the legs can be in the assembled shooting position, already attached to the table top at four designated coupling points. The legs are also of telescopic design and are of aluminum conduit. The outer leg side wall is drilled and tapped to accept a set screw. A leg adjustment element positioned in the leg conduit can be slid in or out to a desired length and then clamped to the desired length by a set screw. This technique enables the table to be leveled in any type of terrain. When the legs are at their minimum length the table is 18 inches high. When the legs are at their maximum length the table is 32 inches high. Of course other dimensions may be used.

An adjustable gun rest is attached to the forward part of the frame. It is mounted on a mounting block that is integrally attached to the front end of the table frame. The gun rest can be attached to the shooting table while being carried or it can be put in the main backpack while in transit. It has an adjusting height of 9 inches and down to 2¼ inches. Other dimensional heights may be used.

Shoulder straps tied to holes in the frame extend over the shoulders of the carrier when the invention is being transported. The backpack and the straps are made of nylon which makes tying and adjustment easy. Both the backpack and the straps can be left on the backpack table while shooting. This shooting table is designed to enable a shooter to perform precision shots in the field under hunting conditions that he/she could only expect to do on his/her favorite rifle range. The invention's appearance is that of a backpack frame which is adaptable for carrying by any size person. The table will also accommodate any size marksman. Everything on or about the table has been designed for adjustment and versatility including the backstraps, the table length, the legs, and a gun rest that is capable of accepting any firearm, as well as adjusting to any usable height.

OBJECTS OF THE INVENTION

It is an object of this invention to provide a novel portable shooting table combined with a knapsack which may be easily transported and used in hunting situations.

It is another object of this invention to provide a portable shooting table forming part of a backpack which may be easily assembled in the field.

It is still another object of this invention to provide a portable shooting table having adjustable length legs which may be easily set up on uneven or slanting terrain.

It is still another object of this invention to provide a combined backpack and shooting table with removable legs that may be carried in the backpack.

It is yet another object of this invention to provide an adjustable height rifle support positioned on a portable backpack shooting table frame.

It is still another object of this invention to provide a portable shooting table with removable and adjustable legs and adjustable length.

It is another object of this invention to provide a portable shooting table backpack which may be easily used under hunting conditions.

Still another object of this invention is to provide a portable shooting table which is ruggedly constructed.

It is another object of this invention to provide a combined backpack frame and shooting table in which the backpack and the backpack frame carrying straps can remain connected to the backpack frame table while it is used as a shooting table.

Yet another object of the invention is to provide a backpack the frame of which serves as a rigid shooting table top.

Still another object of this invention is to provide a backpack bag having carrying straps attached to connecting apertures in the backpack frame.

DESCRIPTION OF THE DRAWINGS

These and other objects of the invention will become more apparent from the following detailed disclosure and claims and by reference to the accompanying drawings, in which:

FIG. 3 is a third dimensional view of the invention in its disassembled transportation mode showing shoulder straps meant to engage the shoulders of a carrier;

FIG. 4 is a view taken along line 4—4 of FIG. 2;

FIG. 5 is a view, partially in section, taken along line 5—5 of FIG. 2;

FIG. 6 is a view, partially in section, taken along line 6—6 of FIG. 2.

DESCRIPTION OF THE PREFERRED EMBODIMENT

Figure 1:
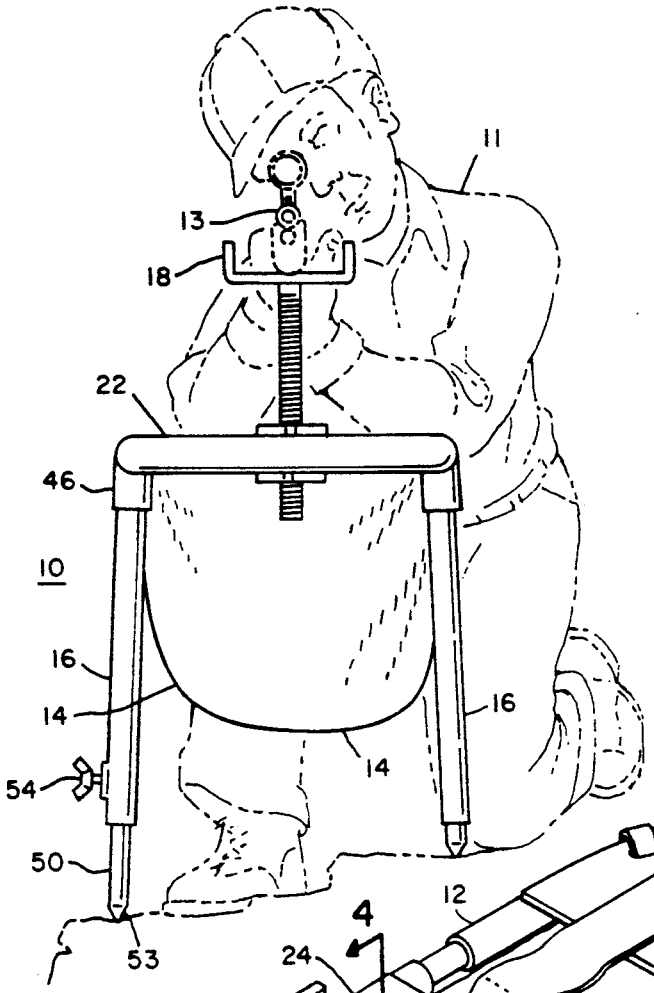
FIG. 1 is a front elevation view of the invention in its assembled shooting mode showing a shooter in phantom view with his rifle supported by the shooting table.
Figure 2:
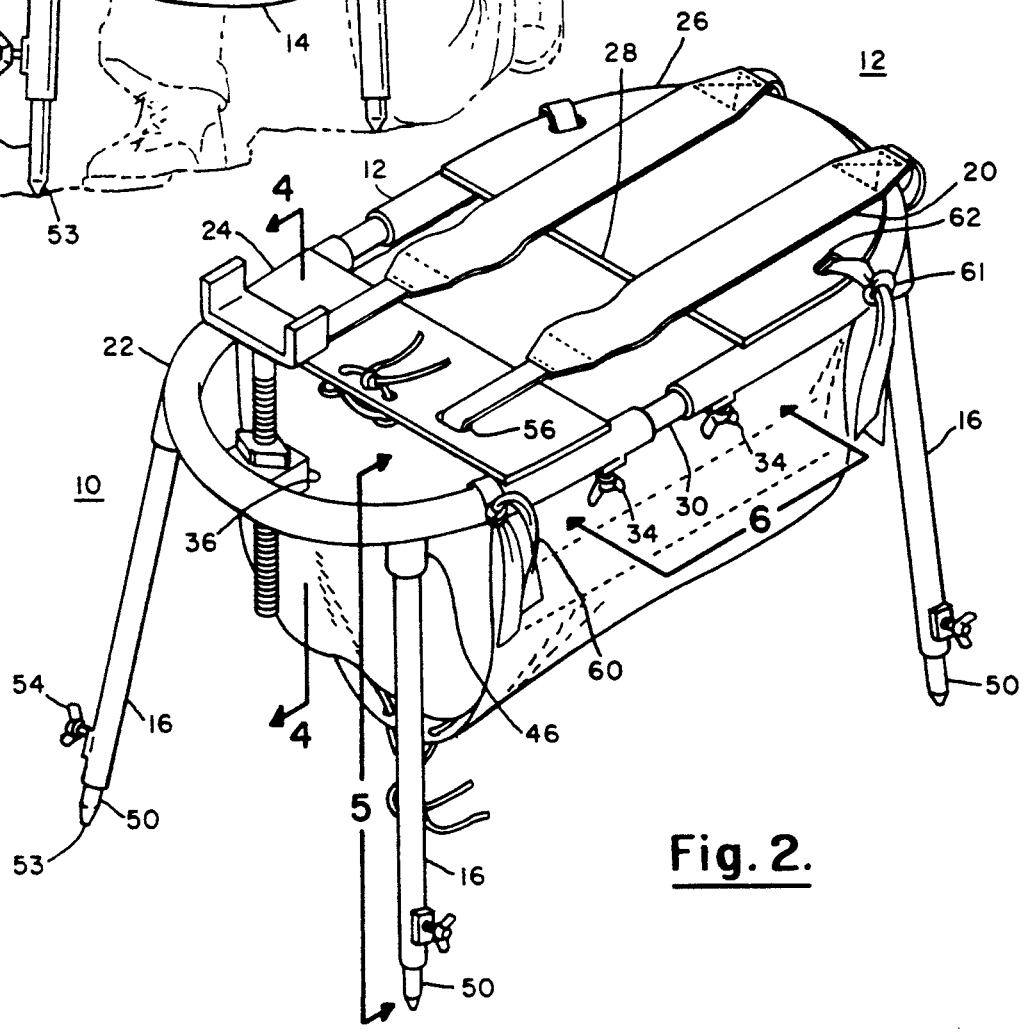
FIG. 2 is a third dimensional view of the backpack shooting table in its assembled shooting mode.

Referring to the drawings and in particular to FIGS. 1 and 2, 10 represents the backpack shooting table in its assembled shooting mode with the shooter 11 in a kneeling position aiming his rifle 13 at a target. Generally the backpack shooting table 10 is comprised of an oval tubular frame 12 to which is attached a backpack bag 14 extending downwardly therefrom. Frame 12 is split in the mid portion to form an adjustable front section 22 and rear section 26. Four adjustable legs 16 are removably attached to the frame 12 and extend downwardly therefrom to the ground. An adjustable gun rest 18 is screw attached to the front section 22 of frame 12 and extends upwardly therefrom to support rifle 13 when the invention is in the assembled shooting mode. A backpack bag 14 is tied to frame 12 by means of attached upper straps 60 and lower straps 61. In the carrying mode two shoulder straps 20 are tied to the front and rear sections 22 and 26 of frame 12 and are designed to pass over the shoulders of the shooter 11 when he is transporting the invention on his back.

In more specific detail, frame 12 is comprised of a semi oval shaped front section 22 having a front support plate 24 welded transversely across. Semi oval shaped rear section 26 of frame 12 has a rear support plate 28 welded transversely across. Support plates 24 and 28 increase the rigidity of frame 12 and present a solid flat surface on which the shooter 11 may rest his arms while aiming the rifle 13. It should be noted that the circumferential portion of frame 12 is comprised of tubular stock, usually aluminum. Other substances such as resin reinforced fiberglass, plastics, metal and other materials may be used however.

Referring to FIG. 6, the two tubular end portions of front section 22 of frame 12 are adjustably connected to the tubular rear section 26 by means of cylindrical shaped extension elements 30 which extend into the adjacent hollow portions of front section 22 and rear section 26. Clamp screws 34 are screw attached to extension blocks 32 which are welded to the tubular frame 12. Clamp screws 34 are thread attached and extend through extension blocks 32 and the tubular sides of front section 22 and rear section 26 where they bear against extension elements 30, clamping them in place. Clamp screws 34 have a wing shaped end to aid in hand turning. As may be seen the length of frame 12 may be adjustably extended by loosening clamp screws 34, pulling front section 22 away from rear section 26 and then tightening clamp screws 34 against extension elements 30. The shooter may thus adjust the shooting table 10 to the desired length.

Referring to FIGS. 2, 3 and 4, a gun rest mounting block 36 is welded to the forward part of front section 22 of frame 12. Block 36 has a smooth hole 38 therethrough which extends approximately vertically when the invention is in its assembled shooting mode. A U-shaped gun rest 18 has a threaded adjustment pillar 42 attached thereto. Adjustment pillar 42 extends through smooth hole 38 and is clamped to mounting block 36 by means of clamping nuts 44 on either side of mounting block 36. Clamping nuts 44 are are screw engaged on adjustment pillar 42 and are tightened against mounting block 36. The height of gun rest 18 may be changed by rotating pillar 42 against clamping nuts 44. The shooter 11 may thus adjust the desired height of his rifle 13 accurately to get the most effective aim. U-shaped gun rest 18 is covered with a rubber-like plastic coating. This coating is applied by dipping U-shaped gun rest 18 into a plastic liquid and allowing it to dry. Thus all surfaces of gun rest 18 have a smooth pliable coating which will not scratch rifle 13 when it is rested on gun rest 18.

Referring to FIGS. 1, 2 and 5, two internally threaded downwardly disposed leg coupling elements 46 are positioned on front section 22 and two internally threaded downwardly disposed leg coupling elements 46 positioned on rear section 26. Coupling elements 46 have internal threads and engage the threaded end portions 48 of legs 16. Leg coupling elements 46 are so positioned that legs 16 will extend outwardly from the plane of shooting table 10 to give a broader and more secure base. Leg 16 is made of hollow tubing and has a cylindrical leg adjusting element 50 extending longitudinally into the hollow of the tubular leg 16. An extension block 32 having a threaded hole therethrough is welded on the side of leg 16. A leg clamp screw 54 is thread attached and extends through extension block 32, leg 16 and bears against the leg adjusting element 50 within leg 16. Clamp screw 54 and block 32 are the same type that are used to clamp front section 22 and rear section 26 and have similar numbers. The end portion of leg adjusting element 50 has a point 53 thereon to enable it to be pressed into the ground.

As may be seen the length of any leg 16 may be adjusted by loosening clamp screw 54, positioning leg adjusting element 50 and reclamping clamp screw 54. It should be noted that the individual adjustment of each leg permits the invention to be positioned on uneven or sloping ground while maintaining the horizontal surface of the shooting table 10. FIG. 1 shows the invention positioned on uneven ground in which two legs 16 are longer than the remaining two legs 16. At the shooter's discretion however, the legs 16 may be so positioned that the surface of the shooting table 10 is at an angle to the horizontal.

The shoulder strap assembly consists of a padded shoulder-contact section with double shoulder straps 20 sewn to each end of the shoulder-contact section. Two upper shoulder straps 20 extend through upper strap holes 56 of front support plate 24 and are tied together. Two lower shoulder straps 20 extend through lower strap holes 58 in rear support plate 28 and are tied together about frame 12. Thus the shoulder strap assembly is supported by the shoulders of a shooter 11 and the shooting table 10 carried in the manner of a backpack.

Referring to FIGS. 2 and 3, the side of backpack bag 14 adjacent to front support plate 24 and rear support plate 28 is generally rectangular in shape. Two attaching straps are sewn to each corner section of the rectangle; upper double strap 60 to the top portion of backpack bag 14 and lower double strap 61 to the bottom portion of backpack bag 14. Hence there are two straps or double straps extending from each corner. Upper double straps 60 are then tied together about frame 12 adjacent to support plate 24. Lower double straps 61 extend through lower strap holes 62 of rear section 26 and are tied together about frame 12.

Backpack bag 14 is generally the shape of a rectangular prism having an open end portion adjacent to front section 22. The open section of backpack bag 14 is covered by backpack cover 70 attached to backpack bag 14. Backpack bag 14 may be made of cloth, canvas, textiles, plastic or other supple material. It may also be constructed of rigid material capable of being shaped into container-like form.

Backpack bag 14 has four longitudinally positioned leg pockets 64 adapted to receive the four legs 16 while the invention is being carried on the shooter's back. During transport the gun rest 18, pillar 42 and clamping nuts 44 may be stored in the backpack bag 14 with any other items the shooter chooses to take. Ammunition, bean bags, lunch, extra clothing and footwear are good choices. Drawstring 66, threaded through the open portion of backpack bag 14 and through front support plate 24, may be tightened and tied, thus securing items in the backpack bag 14. In addition the inner side of backpack cover 70 has an adhesion strip (VELCRO TM) 68 thereon. This is designed to adhere to a mating adhesion strip sewn to the rear surface of backpack bag 14. Backpack cover 70 may be thus secured in closed position.

In operation the invention in the disassembled transportation mode is shoulder carried to the area where shooting is to take place. The invention is removed from the shoulders, the four legs 16 are removed from leg pockets 64 and screwed into leg coupling elements 46. Gun rest 18 and adjustment pillar 42 are removed from the backpack bag 14. Adjustment pillar 42 is inserted in the smooth hole 38 of the mounting block 36 and clamping nuts 44 screwed in a clamping relationship onto the adjustment pillar 42 on either side of the mounting block 36. If the shooter 11 wishes to extend the length of frame 12, clamp screws 34 are loosened, front section 22 pulled from rear section 26 and clamp screws 34 tightened on extension element 30. The shooter 11 may then adjust the height of gun rest 18 by turning threaded adjustment pillar against clamping nuts 44.

The height of legs 16 may then be adjusted by loosening leg clamp screws 54 and pulling out adjustment element 50 to the proper length. Leg clamp screws 54 may thus be tightened against leg adjustment element 50 securing it firmly in place. As may be seen in FIG. 1, the legs 16 may be adjusted on uneven or slanting terrain so that the tubular frame 12 remains horizontal. If the shooter 11 desires, the frame 12 can also be set at an angle to the horizontal.

The shooter 11 may then kneel, sit or lie behind the shooting table 10 with a rifle 13 resting on gun rest 18 and with his arms, elbows or rifle 13 resting on front support plate 24 and rear support plate 28. If desired the shooter 11 may place a sand bag or other support on rear support plate 28 and rest the butt of his rifle 13 on the sand bag or other support. Gun rest 18 may then be raised or lowered by adjusting clamping nuts 44 until the target is centered in the rifle sights. At this point the shooter 11 has solid support for a rifle 13 and may slowly squeeze the trigger of the rifle 13 until it discharges, thus insuring an accurate shot at the target. Extremely long and accurate shots are possible in the hunting environment with the backpack shooting table 10.

When the shooter-hunter wishes to change his location he may simply disassemble the shooting table 10, place the legs 16 and gun rest 18 inside of the backpack bag 14. The shooter 11 may then lift the invention on both shoulders using shoulder straps 20 and walk to his new location. It should also be noted that the shooting table 10 may be left completely assembled with legs and gun rest attached while it is being shoulder carried by the shooter 11. In this case, the gun rest 18 is set at a low position to avoid contacting the shooter's body. When the shooter 11 reaches his new location he can place the assembled shooting table 10 on the ground for use. Shooting table 10 is thus easily adjusted, assembled, disassembled and carried. The invention may be utilized as a backpack bag alone for carrying items during the hunt.

This invention has been described with a degree of specificity. Various modifications and changes may be made without departing from the spirit of the invention.

What is claimed is:

1. A portable back pack shooting table for use in aiming a firearm adapted to be back transported in both a disassembled transportation mode and assembled shooting mode, comprising in combination:

an oval shaped frame, said frame having a forward section and a rear section thereon;

a forward support plate extending across said forward section and attached thereto, said forward support plate having shoulder strap attaching holes therethrough;

a rear support table extending across said rear section and attached thereto, said rear support table having both shoulder strap attaching holes therethrough, and back pack attaching holes therethrough;

a back pack bag having attaching straps thereon, said attaching straps tied to said back pack attaching holes;

shoulder straps tied to said shoulder strap attaching holes;

legs removably attached to said oval shaped frame, extending generally perpendicular from said oval shaped frame;

a leg adjusting element movably positioned within each of said legs;

an extension block attached to the side of each leg, said extension block and leg having a threaded hole therethrough;

a threaded clamping screw within said threaded hole in clamping relationship with said leg adjusting element;

a gun rest assembly attached to said forward section of said oval shaped frame comprising in combination:

a mounting block attached to an inner side of said forward section of said oval shaped frame and extending into a plane formed by said oval frame, said mounting block having an adjustment hole therethrough;

a threaded adjustment column extending through said adjustment hole;

a U-shaped gun rest attached to the end portion of said threaded adjustment column;

clamping nuts in threaded engagement with said threaded adjustment column, positioned on either side of said adjustment column and in clamping relationship with said mounting block.

2. The combination as claimed in claim 1 having means for adjusting the length of said oval shaped frame, said means comprising in combination:

a divided oval shaped frame comprised of said forward section and said rear section, said divided frame comprised of hollow tubing;

an extension member positioned within the hollow tubing of said forward section and within the hollow tubing of said rear section;

a first clamp screw extending through said forward section and in clamping contact with said extension member;

a second clamp screw extending through said rear section and in clamping contact with said extension member.

3. The combination as claimed in claim 2 in which said oval shaped frame holds said back pack.

4. The combination as claimed in claim 3 having leg coupling elements attached to said oval shaped frame;

said leg coupling elements screw attached to each of said legs.

5. The combination as claimed in claim 4, in which said back pack bag has pockets therein to contain said legs during the disassembled transportation mode.

6. The combination as claimed in claim 5, which when the back pack shooting table is in the assembled shooting mode, said forward support plate and rear support plate are horizontal and present a rigid surface supporting said shooter and rifle.

7. The combination as claimed in claim 6, in which said leg adjusting element has a pointed end portion thereon adapted to penetrate the ground.

8. The combination as claimed in claim 7 in which said firearm is supported by said U-shaped gun rest and by said rear support table.

* * * * *